US005778967A

United States Patent [19]

Lauener

[11] Patent Number: 5,778,967

[45] Date of Patent: Jul. 14, 1998

[54] SIDE DAM FOR A CASTER HAVING IMPROVED CONTACT WITH SOLIDIFYING METAL

[75] Inventor: Wilhelm F. Lauener, Gerlafingen, Switzerland

[73] Assignee: Larex A.G., Solothurn, Switzerland

[21] Appl. No.: 567,181

[22] Filed: Jan. 11, 1996

[51] Int. Cl.[6] ..... B22D 11/06

[52] U.S. Cl. ..... 164/481; 164/431

[58] Field of Search ..... 164/479, 481, 164/430, 431, 432, 435, 491, 436

[56] References Cited

U.S. PATENT DOCUMENTS

| | | |
|---|---|---|
| 4,239,081 | 12/1980 | Kranz . |
| 4,601,324 | 7/1986 | Artz et al. . |
| 4,620,583 | 11/1986 | Koide et al. . |
| 4,694,899 | 9/1987 | Wood et al. . |
| 4,785,873 | 11/1988 | Lauener . |
| 4,794,978 | 1/1989 | Lauener . |
| 4,798,315 | 1/1989 | Lauener . |
| 4,854,371 | 8/1989 | Katahira et al. . |
| 4,869,310 | 9/1989 | Yanagi et al. . |
| 4,934,441 | 6/1990 | Wood et al. . |
| 4,964,456 | 10/1990 | Lauener . |

FOREIGN PATENT DOCUMENTS

| | | | |
|---|---|---|---|
| 864035 | 6/1978 | Belgium . | |
| 63-264251 | 11/1988 | Japan | 164/431 |
| 63-264252 | 11/1988 | Japan | 164/431 |
| 63-278645 | 11/1988 | Japan | 164/431 |
| 64-75150 | 3/1989 | Japan | 164/431 |
| 1-99753 | 4/1989 | Japan | 164/431 |
| 1-166866 | 6/1989 | Japan | 164/431 |
| 1-293947 | 11/1989 | Japan | 164/431 |

OTHER PUBLICATIONS

Translation of Belgian Patent 864,035 Published Jun. 16, 1978.

*Primary Examiner*—J. Reed Batten, Jr.

*Attorney, Agent, or Firm*—David V. Radack; Eckert Seamens Cherin & Mellott, LLC

[57] ABSTRACT

The side dam includes a frame, an orbiting chain and a plurality of elements connected to the chain. The elements each include a carrier connected to the chain and a block mounted to the carrier. The element further includes a spring or other biasing member for urging the block to bow toward an outer edge of the solidifying molten metal in the mold.

19 Claims, 5 Drawing Sheets

SIDE DAM FOR A CASTER HAVING IMPROVED CONTACT WITH SOLIDIFYING METAL

BACKGROUND OF THE INVENTION

This invention relates to an improved side dam for a caster, and more particularly to an improved side dam that is constructed to maintain side dam to slab contact while molten metal is solidifying in the casting zone.

Casters are known devices in which molten metal is cast into a mold and solidified therein to create a metal product, such as slab, strip or bar. One type of caster is a twin belt continuous caster, such as that disclosed in U.S. Pat. No. 4,964,456. This caster includes a pair of opposed movable belts and a pair of opposed movable side dams which together form a mold into which molten metal is introduced for subsequent solidification. These casters can also be oriented substantially horizontally. See, e.g., U.S. Pat. No. 4,061,177.

As stated above, the mold is defined on two sides by a pair of opposed side dams. There are numerous types of side dams, including stationary side dams and movable side dams. One type of movable side dam is shown in U.S. Pat. No. 4,794,978. That patent shows a plurality of side dam elements which travel over two pulleys. Each element consists of a carrier and an easily exchangeable block which is connected to the carrier. The patent states that the side dam's plane of motion is parallel to the mold wall's plane of motion and can be adjusted at any desired depth between the casting mold walls.

Despite the effectiveness of this device, a problem remained in that as the molten metal solidified, it shrank, and thus an air gap was created between the outer edge of the solidifying molten metal and the side dam block. This air gap is undesirable because of the loss of heat transfer between the solidifying molten metal and the block of the side dam. This leads to undesirable metallurgical properties in the cast metal product.

Therefore, what is needed is an improved side dam that is structured to maintain side dam to metal product contact while the molten metal is solidifying in the mold.

SUMMARY OF THE INVENTION

The invention has met or exceeded the above-mentioned need as well as others. The invention provides a side dam for a caster defining a mold in which molten metal is cast into a metal product. The side dam comprises a frame, orbiting means, such as a chain, mounted to the frame and a plurality of elements connected to the orbiting means in a chain-like manner. The elements each include a carrier connected to the orbiting means and a block mounted to the carrier. The element further includes means for urging the block toward the outer edge of the solidifying molten metal in the mold.

The invention also includes a method of casting molten metal into a metal product. The method comprises providing a caster defining a mold, the caster including at least one side dam. The side dam is an orbiting side dam including a frame, orbiting means mounted to the frame and a plurality of elements connected to the orbiting means in a chain-like manner. The method then comprises introducing the molten metal into the mold and effecting solidification of the molten metal into the metal product in the mold. The method finally comprises urging the side dam toward the outer edge of the solidifying molten metal in the mold.

BRIEF DESCRIPTION OF THE DRAWINGS

A full understanding of the invention can be gained from the following description of the preferred embodiment: when read in conjunction with the accompanying drawings in which.

DETAILED DESCRIPTION

As used herein, the term "metal product" means primarily clad or unclad strip or slab made substantially of one or more metals, including without limitation, aluminum and aluminum alloys and can also include, in a broader sense, clad or unclad bar, foil or rod.

This invention relates to side dams for casters in which molten metal is formed into a metal product, such a, strip, slab or bar. As is known, there are several types of casters, such as block casters and belt casters. These casters can be either horizontally or vertically oriented. Although the following detailed description focuses on the side dam of the invention as used on a vertical twin belt: caster, it will be appreciated that the invention is not so limited and can be used on other types of casters where a side dam is required or desirable.

Figure 1:
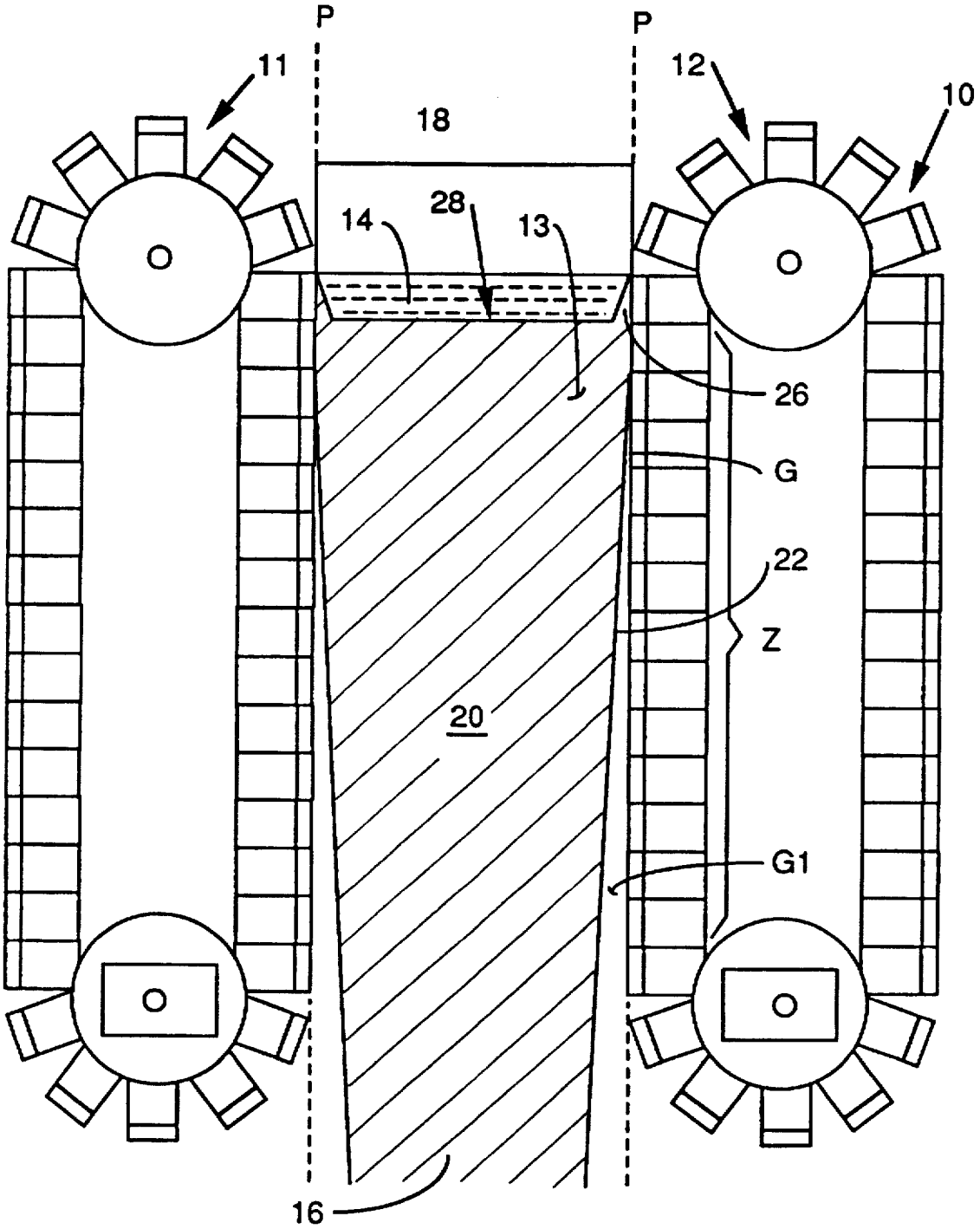
FIG. 1 ( PRIOR ART )
FIG. 1 is a schematic elevational view showing molten metal being solidified in a mold defined by side dams of the prior art.

Referring now to FIG. 1, prior art side dams 10 and 11 are shown in use with a twin belt vertical caster 12. As is known, a twin belt caster includes a pair of opposed movable belts and a pair of opposed movable side dams, the belts and side dams defining a mold 13 in which molten metal 14 is solidified into a metal product 16, such as a strip, slab or bar. The molten metal 14 is introduced into the mold 13 by a nozzle 18, which receives the molten metal from a trough leading from a furnace (not shown). It will he appreciated that many types of molten metal can be cast in the caster, such as, for example, aluminum, steel and copper.

FIG. 1 shows the solidification of the molten metal 14 into a metal product 16 in the mold 13. The particular metal product 16 shown in FIG. 1 is a slab, having a width of between 50 to 200 cm and a thickness of about 1 to 3 cm. The view shown in FIG. 1 shows a first major surface 20 and the outer edge 22 of the slab.

The molten metal solidifies generally in the pattern shown in FIG. 1, that is, the molten metal starts out molten near the top of the mold, but quickly develops an outer metallic shell 26. As the molten metal goes through the mold, the outer shell grows in thickness, creating what is known as sump 28 which contains molten metal. The final solidification of the molten metal 14 into a metal product 16 occurs in the middle of the slab. Once the molten metal is completely solidified, it is moved out of the casting zone Z at casting speed by the movable belts.

As can be seen in FIG. 1, as the molten metal 14 solidifies into a metal product 16 in the mold 13, the metal product 16 shrinks in width. The amount of this shrinkage varies from metal to metal and also from alloy to alloy. For example, an average shrinkage of and aluminum alloy can be or the order of 1%. If the mold 13 has a width of 200 cm (80 inches) the shrinkage can be 2 cm (about 0.8 inches). This means that a gap, such as gap G between side dam 10 and outer edge 22, being anywhere from 0.25 to 1 cm (0.125 inches to 0.4 inches) can form between the side dam and the solidifying molten metal. It will be observed from FIG. 1 that this gap can begin near the top of the mold 13, and can get progressively larger as the slab moves through the mold 13. The. gap, such as gap G1, can be at a point where the molten metal is not completely solidified in the mold 13. It will be appreciated that the gaps G and G1 are shown slightly exaggerated in FIG. 1 in order to better illustrate the problem. Gap G is undesirable because of the reduction of heat transfer which can result in melt through. However, after solidification, it is not as necessary to maintain side dam to slab contact. Thus, gap $G_1$ is not a major concern.

Figure 2:
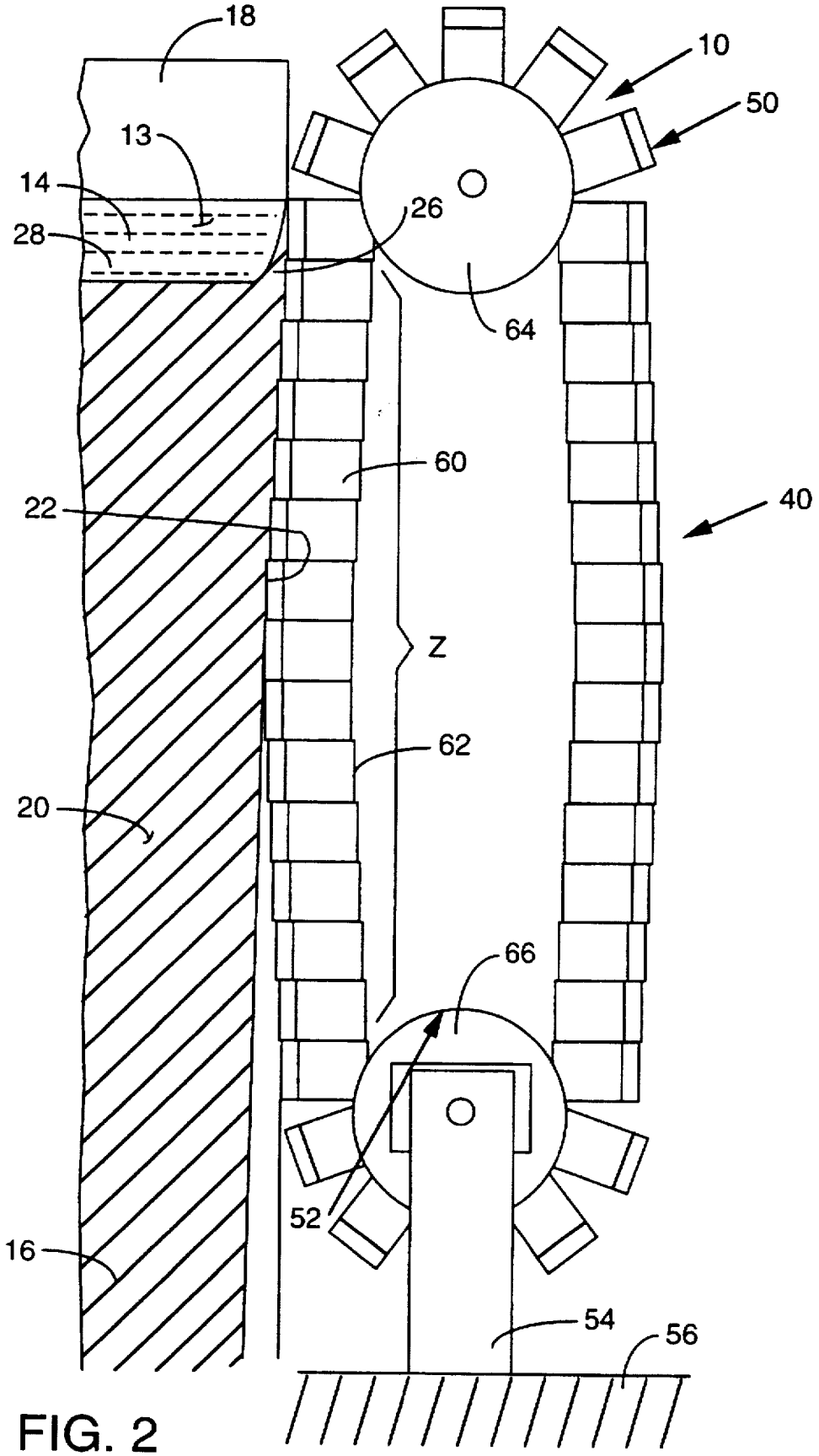
FIG. 2 is a view similar to FIG. 1, only showing the side dam of the invention.

Referring now to FIG. 2, where like reference characters refer to like elements shown in FIG. 1, a twin belt caster 40 having side dams of the invention are shown. This figure is a schematic, slightly exaggerated view of the side dam. As can be seen, side dam 50 is constructed and arranged so that it maintains substantial surface-to-surface contact with the outer edge 22 of the solidifying molten metal 14 in the mold 13, especially near the top of the mold, where the molten metal 14 is beginning to solidify to form the shell 26 of the metal product 16.

The side dam 50 shown in FIG. 2 (side dam 51 is similar in construction as side dam 50 so it will not be discussed in detail) consists of a frame 52 which is supported by a vertical support 54 anchored to the floor 56 of the caster. The side dam 50 consists of an endless chain-like system in which a plurality of elements, such as element 60, are secured to orbiting means, such as a chain 62. The chain 62 is guided over two pulleys 64 and 66. For a more detailed description of the operation and structure of the side dam 50, see U.S. Pat. No. 4,794,978 which is expressly incorporated herein by reference.

The path of the outer edges of the individual elements of the side dam 50 as shown in FIG. 2 allows the side dam 50 to maintain intimate surface-to-surface contact with the outer edge 22 of the solidifying slab. The path of the outer edge is made possible by the construction and arrangement of the separate elements, such as element 60, of the side dam 50. This construction and arrangement will be discussed in detail hereinbelow with respect to FIGS. 3 and 4. Substantial side dam to slab contact resists air gaps between the outer edge 22 of the solidifying slab and the side dam 50. This reduces the attendant problems mentioned above or at least significantly reduces them.

Figure 3:
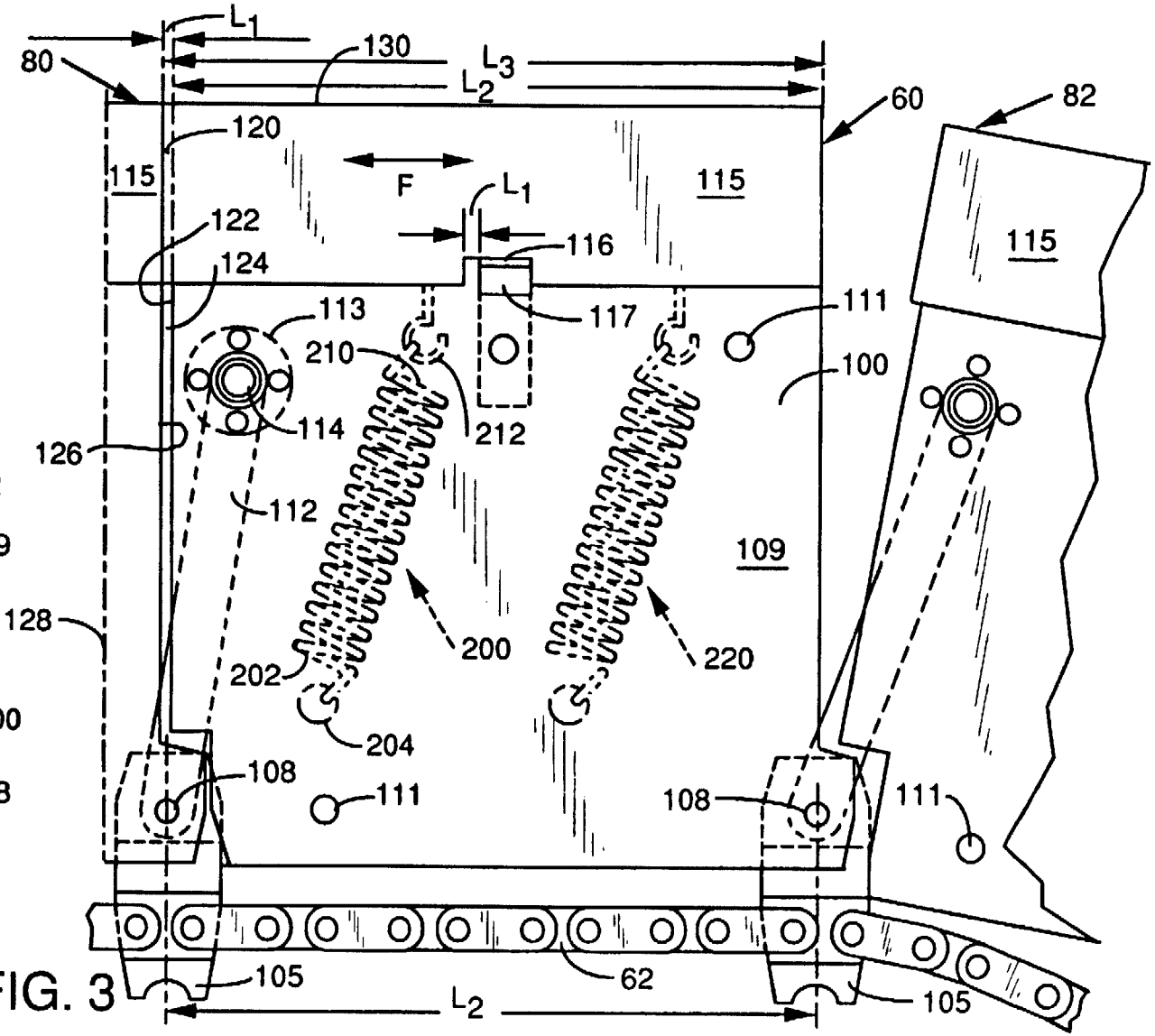
FIG. 3 is an elevational view of an individual element of the side dam.
Figure 4:
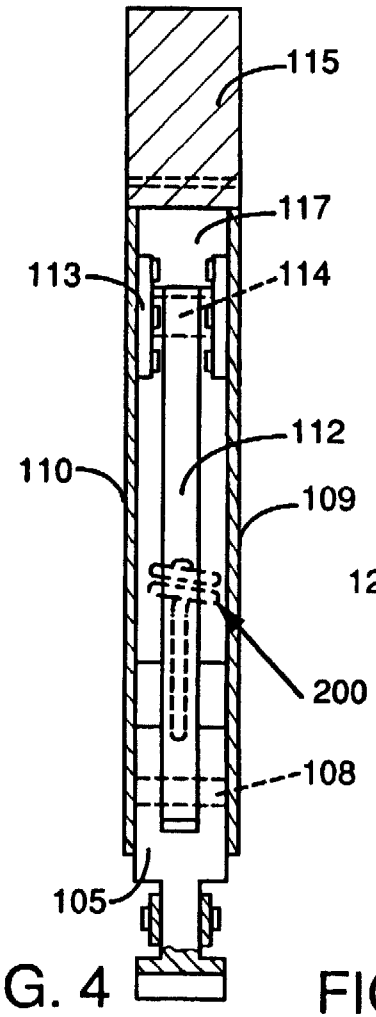
FIG. 4 is a cross-sectional view of the side dam element shown in FIG. 3.

Referring now to FIGS. 3 and 4, the mechanism for accomplishing substantial surface-to-surface contact between the side dam elements and the outer edge 22 of the solidifying slab is shown. Element 60 (from FIG. 2) along with portions of elements 80 and 82, which are adjacent to element 60 are shown in FIG. 3. Each element consists of a carrier 100 which is connected to the chain 62 of the side dam 50. The connection of the carrier 100 to the chain 62 is accomplished by feet 105. Each of the feet 105 is pivoted on a pin 108 between two side plates 109 and 110 (FIG. 4) of the box-shaped carrier 100. The side plates 109, 110 are rigidly fastened together by means of bolts and rivets 111. A coupling bar 112 is pivoted on the pin 108 of the side plates 109, 110. At the other end, the coupling bar 112 is also hinged to the outer end of the neighboring side plates 109, 110 by means of a pin 114 in bearing bushes 113. Thus the side plates 109, 110 are connected to the outer side of the chain 62 in such a manner as to allow for a certain mobility, radially and tangentially of the carriers in relation to the chain. The side dam elements are not primarily supported on the pulleys 64 and 66 by way of the chain 62 or the side plates 109, 110, but by way of the feet 105 of the carriers. Each side plate 109, 110 bears a block 115 which consists of a suitable material, for example a refractory, metal, or a material that is protected by means of a refractory or chemical coat. Each block 115 has a keyway 116 in the middle which takes hold of a key 117 which is fastened to the outer side of the side plates 109, 110.

As can best be seen in FIG. 3, the block 115 has a portion 120 which extends beyond an edge 122 of the carrier 100. This creates a space 124, having a length $L_1$ between the edges of adjacent carriers, such as edge 122 of carrier 100 and edge 126 of carrier 128 of element 80. Thus, the length $L_2$ between the centers of pins 108 is less than the length $L_3$ of the outside edge 130 of the block 115 by an amount equal to $L_1$. Exemplary lengths $L_1$ and $L_2$ are on the order of 0.3 mm for $L_1$ and 152.4 mm for $L_2$, or with $L_1$ being about 0.2% of $L_2$. Of course, these lengths can be adjusted to any desired length, the important point being that the length of the outside edge 130 is greater than the center-to-center length ($L_2$) between adjacent pins 108 of adjacent coupling bars 112 which distance is equal to an even multiplier of the pitch of the chain.

Figure 5:
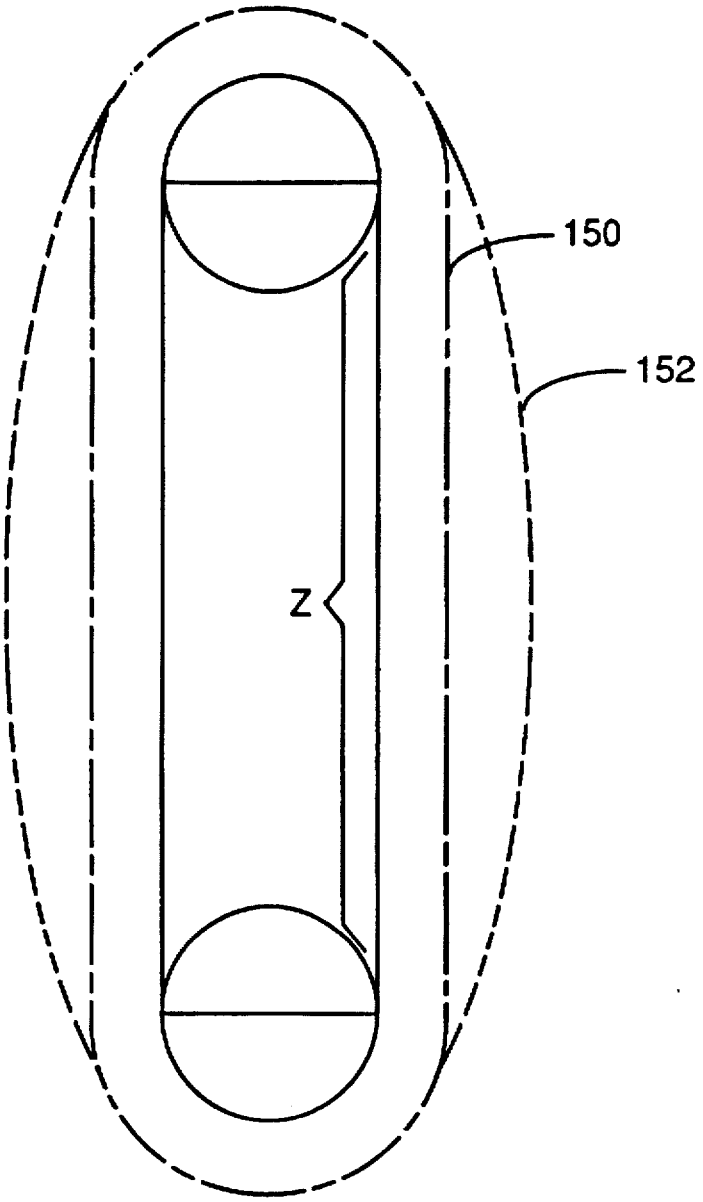
FIG. 5 is a schematic diagram showing the path of the elements of the side dam, if allowed to bow out without restraint.

Because of this length differential, it will be appreciated that a line formed by the outer edges of the individual blocks, such as outer edge 130 of block 115, will form an outwardly bowed shape. This is best seen in FIG. 5, which shows a schematic drawing of the line 150 formed by the outside edges of the elements of a conventional side dam (such as that shown in FIG. 1) and the line 152 formed by the outside edges of the elements of the side dam having a block that is greater in length than the center-to-center distance between adjacent pins for the coupling bar. It will be appreciated that line 152 is exaggerated in FIG. 5 in order to better show the bowing of the line. As can be seen in FIG. 5, the line 152 bows outwardly when the elements are near the top of the mold, thus following the solidification of the slab in the mold so that air gaps between the side dam and the edge of the solidifying slab are resisted. However, as the metal solidifies in the mold, a shell forms. If the outward bow extends too far into the mold, the side dams can break this shell, which is undesirable because molten metal contained in the shell will be able to escape and run down the sides of the mold (similar to breaking the shell of an egg). This will cause undesired metallurgical properties in the as-cast shell. Furthermore, as the elements travel further through the casting zone Z, the line 152 formed by the outside edges of the elements of the side dam start to bow inwardly forming air gaps near the bottom of the mold.

In order to modify the bowing of the line formed by the edges of the blocks of the elements of the side dams, there is provided at least one angularly disposed biasing means, such as spring 200 (FIGS. 3–4) which connects the carrier 100 to the block 115. The spring 200 has a first end 202 which is connected to a first eyelet mounting means 204 secured to the carrier 100 and a second end 210 connected to a second eyelet mounting means 212 secured to the block 115. Element 60 also includes a second spring 220 which is similar in construction and arrangement to spring 200. In addition, block 115 defines a keyway 116 which is greater in length than key 117 by the same amount as length $L_1$, which, as recalled, is the length by which outside surface 130 ($L_3$) is greater than the center-to-center length ($L_2$) between adjacent pins 108 of the coupling bar 112. It will be appreciated, therefore,. that springs 200, 220 serve several purposes. First, they secure the blocks, such as block 115, to the carriers, such as carrier 100, of each element, such as element 60. Secondly, they provide an efficient and effective way to replace a worn block with a new block. This is accomplished by removing the springs 200, 220 from the respective eyelet mountings, removing the old worn block, replacing the new block and then reattaching the springs 200, 220 to the new block.

Figure 6A:
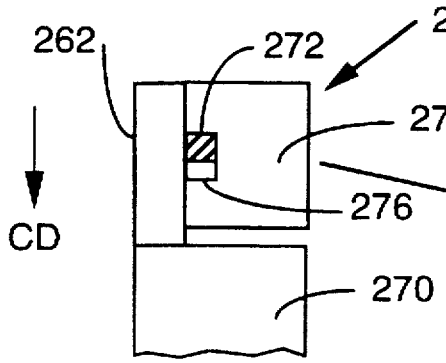
FIG. 6A is a detailed schematic view of a portion of the side dam showing an element as it is positioned near the top of the mold.

Third, the angular orientation of the springs 200, 220 allows the block 115 to move relative to the carrier 100, in the direction of arrow F in FIG. 3. It is this movement which controls the shape of the bow, as will be discussed now with reference to FIG. 6. As the elements travel through the upper portion of the mold, the differences in length between the block 115 and the carrier 100 will cause the line 230 formed by the edges of the side dams to bow outwardly, and thus follow the outer edge 250 of the solidifying slab 252, similarly as was discussed with regard to FIG. 5. As can be seen in FIG. 6A, a particular element 260 is in the position shown in FIG. 3, in which the block 262 is pressing against an adjacent downstream element 270. Because of this, the key 272 of carrier 274 of element 260 is disposed to the upper portion of keyway 276. Fourth, and finally, a tight fit of adjacent blocks can be accomplished while still allowing for thermal expansion thereof due to the structure and arrangement of the blocks.

Figure 6B:
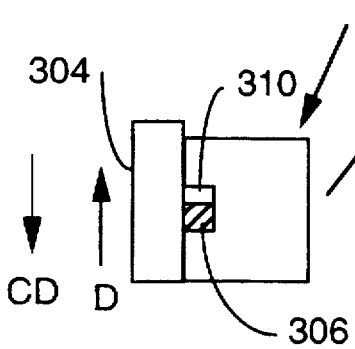
FIG. 6B is a detailed schematic view of a portion of the side dam showing an element as it is positioned when the metallic shell of the solidifying slab exerts a force which overcomes the spring biasing force.
Figure 6C:
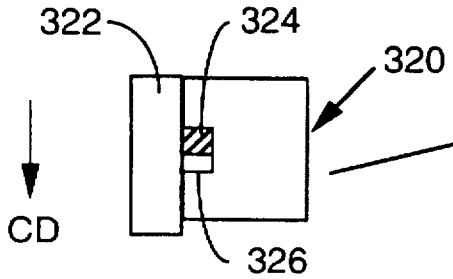
FIG. 6C is a detailed schematic view of a portion of the side dam showing an element as it is positioned near the bottom of the mold.
Figure 6:
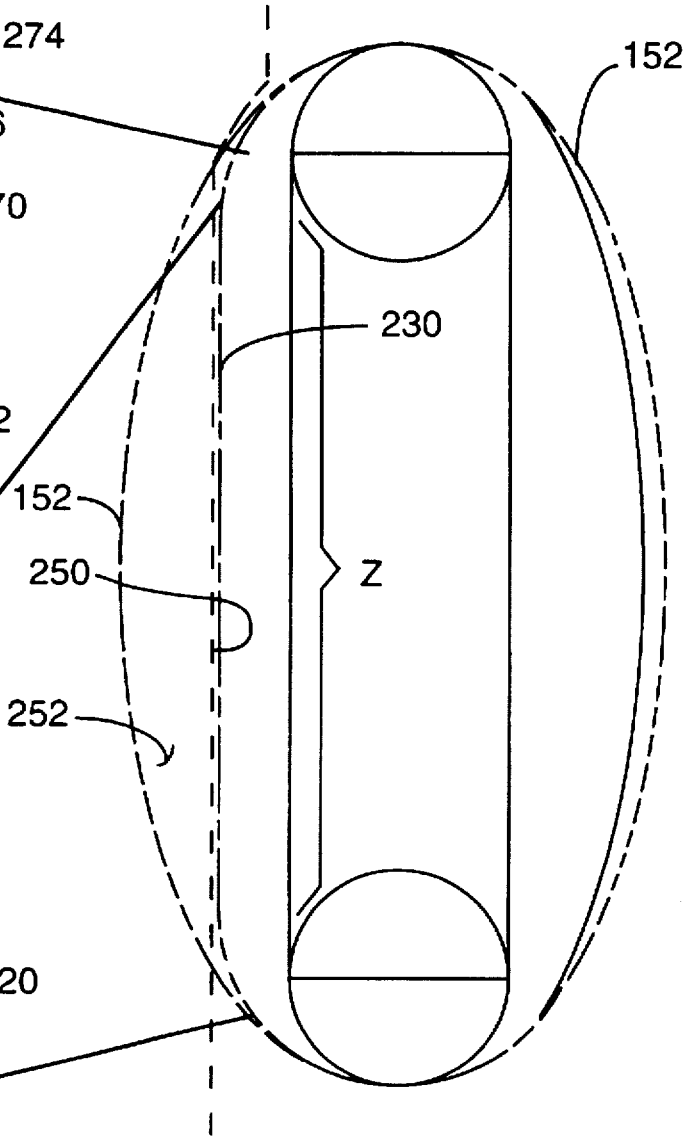
FIG. 6 is a schematic diagram showing the path of the elements of the invention, which are restrained.

As the elements move through the casting zone Z, the solidifying molten metal, although shrinking, will start to exert outward pressure on the edges of the side dams, because the bow is extending too far into the mold. At some point, this pressure becomes great enough to overcome the spring biasing force of a spring (such as spring 200) of particular element, such as element 302 shown in FIG. 6B. This will cause the block 304 of element 302 to move in a direction D opposite of the casting direction CD (FIG. 6B), so that the key 306 of this element 302 is disposed in the lower portion of keyway 310. As can be seen in FIG. 6, this movement causes the shape of the line 230 formed by the edges of the blocks in that area of the casting zone to move inwardly and become almost straight. This inward movement of the line 230, therefore, will take some pressure off of the solidifying shell of the slab, and thus avoid breaking the shell, and the attendant disadvantages associated therewith, as was discussed above with respect to FIG. 5.

Once the pressure of the metal slab is less than the biasing force of the spring, the blocks will snap back into their original position as shown in FIG. 6A. This is shown by observing FIG. 6C where element 320 has a block 322 that is positioned so that key 324 is disposed in the upper portion of keyway 326. The blocks will remain in this position while travelling on the opposite side of the mold, because there is no force to overcome the biasing force. Hence, the characteristic outward bowing (similar to FIG. 5) is shown on the backside of the side dams.

It will be appreciated that the side dam of the invention follows the solidification of the slab in the mold, while not applying too great of a pressure so that breaking of the fragile metal shell of the solidifying slab in the upper part of the mold is resisted. It will be further appreciated that the biasing force of the springs (or, for that matter, any type of biasing members such as elastic rods, for example) can be adjusted so that the proper path for the edges of the side dam can be formed for different metals, and different alloys thereof which, it will be appreciated, have differing solidification rates and patterns. This adjustment can be accomplished by varying the stiffness of the springs, changing the angular orientation of the springs or both.

The method of the invention is a method of casting molten metal into a metal product comprising providing a caster defining a mold, the caster including at least one side dam. The method then comprises introducing the molten metal into the mold and effecting solidification of the molten metal into the metal product in the mold. The method finally comprises causing the side dam to maintain substantial surface-to-surface contact with the outer edge of the solidifying molten metal in the mold, such that air gaps between the side dam and the outer edge of the solidifying molten metal in the mold are resisted.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A side dam for a caster defining a mold in which molten metal is cast into a metal product, said side dam comprising a frame, an orbiting chain mounted to said frame and a plurality of elements connected to said orbiting chain, said elements each including a carrier connected to said orbiting chain and a block mounted to said carrier having an edge for contacting said molten metal and metal product in said mold, each of said elements further including means for urging said edge of said block to bow toward an outer edge of said molten metal as it is solidifying in said mold.

2. The side dam of claim 1, wherein said carrier and said block are proportioned so that said block is urged into substantial surface-to-surface contact with said outer edge of said molten metal as it is solidifying in said mold.

3. The side dam of claim 2, wherein said urging means includes an angularly disposed spring having one end connected to said carrier and an opposite end connected to said block, whereby said block is able to move relative to said carrier while remaining mounted thereto.

4. The side dam of claim 1, wherein said carrier is connected to said chain by a foot member.

5. The side dam of claim 4, wherein adjacent said elements are linked to each other by a coupling bar having one end attached to a said foot member of one said carrier and an opposite end attached to said carrier of said other element.

6. The side dam of claim 5, wherein said coupling bar is attached to said foot member by a pivot pin.

7. The side dam of claim 6, wherein the center to center distance between said pivot pins on adjacent carriers is less than the length of the outer surface of said block.

8. The side dam of claim 7, wherein said center to center distance is about 0.2% less than said length of said outer surface of said block.

9. A method of casting molten metal into a metal product comprising:

providing a caster defining a mold, said caster including at least one side dam having (i) a frame, (ii) orbiting chain mounted to said frame, (iii) a plurality of elements connected to said chain, and (iv) a block secured to each element;

introducing said molten metal into said mold;

effecting solidification of said molten metal into said metal product in said mold; and urging said blocks in said side dam to bow toward an outer edge of said molten metal as it is solidifying in said mold.

10. The method of claim 9, including employing as each said element a carrier secured to said orbiting chain and said block is secured to said carrier, said block is adapted to maintain substantial surface-to-surface contact with said outer edge of said molten metal as it is solidifying in said mold.

11. The method of claim 10, including providing a foot member to connect said carrier to said orbiting chain;

providing a coupling bar having one end attached to said foot member of one said carrier and an opposite end attached to said carrier of an adjacent said element, said coupling bar being attached to said foot member by a pivot pin; and establishing a center to center distance between said pivot pins on adjacent carriers which is less than the length of a surface of said block, whereby said blocks follow said molten metal as it is solidifying in said mold which shrinks as it solidifies.

12. The method of claim 11, including providing connection means for securing said block to said carrier.

13. The method of claim 12, including employing as said connection means at least one angularly disposed spring which enables movement of said block relative to said carrier while at the same time holding said block to said carrier.

14. The method of claim 13, including causing said outward bowing of said side dam to be restrained in a desired zone adjacent to said mold by movement of said block relative to said carrier so that said side dam does not press undesirably hard upon said outer edge of said molten metal as it is solidifying in said mold.

15. The method of claim 14, including adjusting the angle of said spring to control the bowing of said blocks in said mold.

16. The method of claim 15, including adjusting said angle of said spring based on the solidification rate of the molten metal or metal alloy to be cast in said mold.

17. The method of claim 16, including adjusting the stiffness of said spring to control the bowing of said blocks in said mold.

18. The method of claim 17, including adjusting said stiffness of said spring based on the solidification rate of the molten metal or metal alloy to be cast in said mold.

19. The method of claim 9, including employing said method to cast molten aluminum.

* * * * *

UNITED STATES PATENT AND TRADEMARK OFFICE

CERTIFICATE OF CORRECTION

PATENT NO. : 5,778,967

DATED : July 14, 1998

INVENTOR(S) : WILHELM F. LAUENER

It is certified that error appears in the above-identified patent and that said Letters Patent is hereby corrected as shown below:

Column 2, line 35, "a," should be --as--.

Column 2, line 39, delete the semicolon (;) after "belt".

Column 2, line 51, "he" should be --be--.

Column 3, line 8, "and" should be --an--.

Column 5, line 9, delete the period (.) after "therefore,".

Signed and Sealed this

Twenty-second Day of June, 1999

*Attest:*

Q. TODD DICKINSON

*Attesting Officer*

*Acting Commissioner of Patents and Trademarks*